US012145779B2

(12) United States Patent
Martinsen

(10) Patent No.: US 12,145,779 B2
(45) **Date of Patent: *Nov. 19, 2024**

(54) PACKAGING BOX FOR FRUIT, BERRIES AND VEGETABLES

(71) Applicant: BAMA Packaging AS, Oslo (NO)

(72) Inventor: Lars Christian Martinsen, Lørenskog (NO)

(73) Assignee: BAMA PACKAGING AS, Oslo (NO)

( * ) Notice: Subject to any disclaimer, the term of this patent is extended or adjusted under 35 U.S.C. 154(b) by 0 days.

This patent is subject to a terminal disclaimer.

(21) Appl. No.: 18/466,262

(22) Filed: Sep. 13, 2023

(65) Prior Publication Data

US 2023/0415952 A1 Dec. 28, 2023

Related U.S. Application Data

(63) Continuation of application No. 17/047,170, filed as application No. PCT/NO2019/050083 on Apr. 12, 2019, now Pat. No. 11,801,967.

(30) Foreign Application Priority Data

Apr. 19, 2018 (NO) ..... 20180535
Dec. 28, 2018 (NO) ..... 20181681

(51) Int. Cl.
*B65D 5/54* (2006.01)
*B65D 5/00* (2006.01)
(Continued)

(52) U.S. Cl.
CPC ..... *B65D 5/544* (2013.01); *B65D 5/003* (2013.01); *B65D 5/0254* (2013.01);
(Continued)

(58) Field of Classification Search
CPC ..... B65D 5/4295; B65D 5/001; B65D 5/52; B65D 2401/10; B65D 2577/047; B31B 2105/001; B31B 50/83
(Continued)

(56) References Cited

U.S. PATENT DOCUMENTS 1,521,796 A 1/1925 Spittell
2,417,550 A 3/1947 Guyer
(Continued)

FOREIGN PATENT DOCUMENTS

DE 7801916.8 5/1978
EP 0084018 7/1983
(Continued)

OTHER PUBLICATIONS

U.S. Appl. No. 17/047,170 , "Advisory Action", May 17, 2022, 3 pages.
(Continued)

*Primary Examiner* — Christopher R Demeree
(74) *Attorney, Agent, or Firm* — Kilpatrick Townsend & Stockton LLP

(57) ABSTRACT

Packaging box for fruit, berries and vegetables comprising four side walls, a top side, and a bottom side. A portion of a side wall or the top side comprises a pour opening for tamper evident opening and pouring of content stored inside the packaging box. The pour opening comprises tear lines for opening the pour opening and means for accessing a tear grip of the opening portion.

10 Claims, 12 Drawing Sheets

(51) Int. Cl.

| | |
|---|---|
| ***B65D 5/02*** | (2006.01) |
| ***B65D 5/42*** | (2006.01) |
| ***B65D 5/66*** | (2006.01) |
| ***B65D 85/34*** | (2006.01) |

(52) U.S. Cl.
CPC ..... *B65D 5/4204* (2013.01); *B65D 5/4295* (2013.01); *B65D 5/6608* (2013.01); *B65D 85/34* (2013.01)

(58) Field of Classification Search
USPC ..... 229/915, 104, 162.1, 162.3, 162.7, 924; 206/511
See application file for complete search history.

(56) References Cited

U.S. PATENT DOCUMENTS

| | | | | |
|---|---|---|---|---|
| 2,749,014 | A | 6/1956 | Russell et al. | |
| 3,270,941 | A | 9/1966 | Barnes | |
| 3,570,745 | A | 3/1971 | Aoki et al. | |
| 3,735,914 | A | 5/1973 | Collura et al. | |
| 3,952,940 | A | 4/1976 | Malcolm | |
| 4,371,366 | A | 2/1983 | Bower et al. | |
| 5,069,344 | A | 12/1991 | Dehart | |
| 5,271,552 | A | 12/1993 | Mcdonnell | |
| 5,429,296 | A | 7/1995 | Southwell et al. | |
| 5,836,509 | A | 11/1998 | Van Loo | |
| 7,004,378 | B1 | 2/2006 | Tharpe, Jr. | |
| 7,607,566 | B2 * | 10/2009 | Philips | B65D 5/10 229/242 |
| 9,815,585 | B2 * | 11/2017 | Gasior | B65D 5/443 |
| 10,099,812 | B2 * | 10/2018 | Shaw | B65D 5/4233 |
| 10,787,288 | B1 * | 9/2020 | Garthaffner | B65D 5/0245 |
| 10,865,010 | B2 * | 12/2020 | Brundage | B65D 5/16 |
| 10,994,889 | B1 * | 5/2021 | Rumsam | B65D 5/5028 |
| 11,470,988 | B2 * | 10/2022 | Sharon | B65D 5/52 |
| 2004/0084515 | A1 | 5/2004 | Rochefort et al. | |
| 2006/0283928 | A1 | 12/2006 | Walsh et al. | |
| 2007/0039840 | A1 | 2/2007 | Mu et al. | |
| 2011/0290809 | A1 | 12/2011 | Liebowitz et al. | |
| 2012/0061456 | A1 | 3/2012 | Rosas et al. | |
| 2013/0126594 | A1 | 5/2013 | Gasior | |
| 2013/0302489 | A1 | 11/2013 | Marlin | |
| 2013/0313310 | A1 | 11/2013 | Schutz et al. | |

FOREIGN PATENT DOCUMENTS

| | | |
|---|---|---|
| EP | 0230191 | 7/1987 |
| EP | 1084959 | 3/2001 |
| EP | 1422151 | 5/2004 |
| EP | 1958881 | 8/2008 |
| EP | 2698322 | 2/2014 |
| EP | 3085631 | 10/2016 |
| FR | 1357126 | 4/1964 |
| FR | 2599335 | 12/1987 |
| FR | 2656849 | 7/1991 |
| FR | 2670182 | 6/1992 |
| FR | 2781459 | 1/2000 |
| GB | 447136 | 5/1936 |
| GB | 472474 | 9/1937 |
| GB | 2220195 | 1/1990 |
| GB | 2522295 | 7/2015 |
| JP | 11227754 | 8/1999 |

OTHER PUBLICATIONS

U.S. Appl. No. 17/047,170 , "Final Office Action", Mar. 11, 2022, 6 pages.
U.S. Appl. No. 17/047,170 , "Non-Final Office Action", Jun. 22, 2022, 6 pages.
U.S. Appl. No. 17/047,170 , "Non-Final Office Action", Feb. 28, 2023, 7 pages.
U.S. Appl. No. 17/047,170 , "Non-Final Office Action", Sep. 13, 2021, 7 pages.
U.S. Appl. No. 17/047,170 , "Notice of Allowance", Jun. 13, 2023, 5 pages.
EP19789375.3 , "Extended European Search Report", Nov. 15, 2021, 8 pages.
EP19789375.3 , "Office Action", Jun. 26, 2023, 6 pages.
No. 20180535 , "Search Report", Nov. 8, 2018, 3 pages.
No. 20181681 , "Search Report", Jun. 25, 2019, 3 pages.
PCT/NO2019/050083 , "International Search Report and Written Opinion", Aug. 1, 2019, 13 pgs.

* cited by examiner

PACKAGING BOX FOR FRUIT, BERRIES AND VEGETABLES

CROSS-REFERENCES TO RELATED APPLICATIONS

This application is a continuation of U.S. application Ser. No. 17/047,170 filed Oct. 13, 2020, which is a National Stage Entry under 35 U.S.C. 371 of PCT/NO2019/050083 filed Apr. 12, 2019, which claims priority to Norwegian Application No. 20180535 filed Apr. 19, 2018 and Norwegian Application No. 20181681 filed Dec. 28, 2018, the entire contents of which are hereby incorporated for all purposes in their entirety.

BACKGROUND OF THE INVENTION

Present invention relates to a packaging box for fruit, berries and vegetables, where the packaging box is made of environmental friendly materials, such as cardboard.

The packaging industry for packaging portions and small quantum fruits, vegetables, berries and the like for consumers is dominated by plastic based packaging solutions. Resent discoveries has proven that use of plastic is a real threat to nature, and it has become evident that humans need to produce less plastic waste.

Using environmental friendly materials in such packaging is problematic, since the requirement for safekeeping, fresh keeping, transport friendliness and production cost are all elements that need to be considered when selecting packaging method and material.

Plastic packaging has proven to be cheap and easy to produce, easy to make robust enough to stack, and security for the products may be handled at an acceptable level. The flexibility of plastic and the ability to produce almost any form using production techniques such as machines that can heat the plastic material (PVC, PP, PE, POF, PPT, PTGF, APET, ABS, OPP, PS, PET, etc.) and make them soft, then vacuum suction and transform sheet material into various plastic blisters, or extruding techniques is considered a great advantage. A problem for packaging using non-softening or non-extrudable materials is how to make a packaging providing good storage, visibility of product, strength and low enough production price level.

When producing packaging for fruit, berries and vegetables products for the consumer market, it is also vital to provide a packaging that can store products in a preserving manner, providing an environment that is endurable for the packaged products. Problems relates typically to ventilation, withstanding moisture from the environment or the packaged goods, and ability to stack packaging units on top of each other without losing any of the above discussed features.

When using non-transparent materials, it is also a problem for the consumer to get a good understanding of the content of the box in question.

A problem in small portion packaging is that the consumer may want to get access to some of the products for consuming, such as a handful of berries or the like, and then continue to store the remaining products in the packaging box. It is also a desire for the shop retailing the products, to the consumer, that access to the packaged goods can be prohibited prior to purchase is completed. These two requirements are difficult to provide at the same time, and often shops experience customers opening several packages to access and refill/exchange content of the selected packaging box, which the customer then brings to the cashier.

The result is that many of the packaging boxes does not contain required volume or average quality.

BRIEF SUMMARY OF THE INVENTION

It is a goal for the present invention to provide a packaging solving some or all of the problem stated above, and at the same time use only environmental friendly materials for building the packaging boxes.

In a first embodiment a packaging box for fruit, berries and vegetables is provided made of cardboard material having a design providing features for ventilation, easy filling, stackability, visibility of the packaged goods, safety for not being opened before purchase is completed, and easy access to the content of the packaging box for extracting portions of the content.

The packaging box is provided for automated machine packing.

A second embodiment of the packaging box is provided, similar to the first embodiment, but where the packaging box is for manual packing of content.

According to the present invention, the objective is reached by a packaging box defined by the features in the independent claim 1. Further advantageous or alternative embodiments are given in the dependent claims.

So that the manner in which the above-recited features of the present disclosure can be understood in detail, a more particular description of the disclosure, briefly summarized above, may be had by reference to embodiments. The accompanying drawings relate to embodiments of the disclosure and are described in the following:

DETAILED DESCRIPTION OF THE INVENTION

Now a more detailed description of a first embodiment of present invention of a packaging box 1 is discussed in relation to FIG. 1A to FIG. 3F.

It should be understood that although all features are included in the first embodiment, the invention shall also comprise embodiments having only one or a combination of more than one, but not all, features discussed here.

The first embodiment relates to a packaging box for machine packaging. Typically, less material is used in such embodiment compared to a box that should be mounted/filled manually.

Figure 1A:
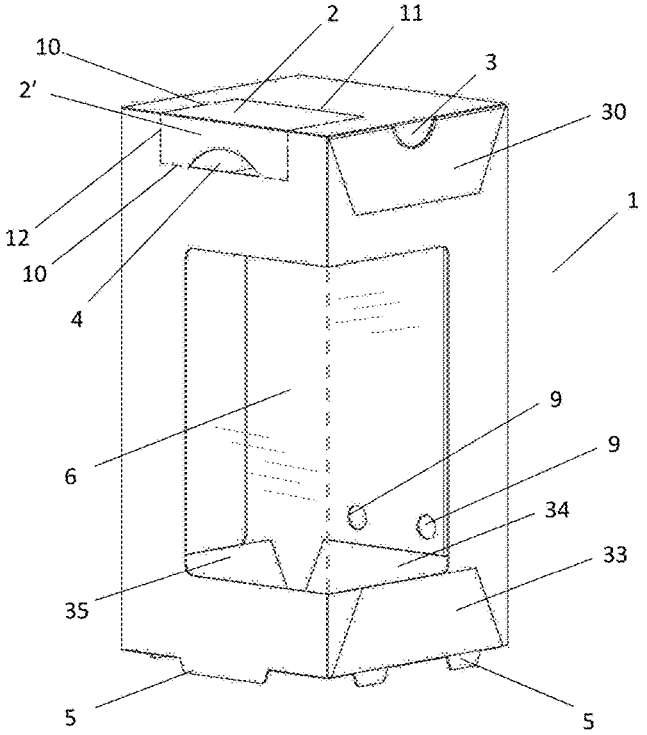
FIG. 1A—packaging box for machine packaging, oblique angle
Figure 1B:
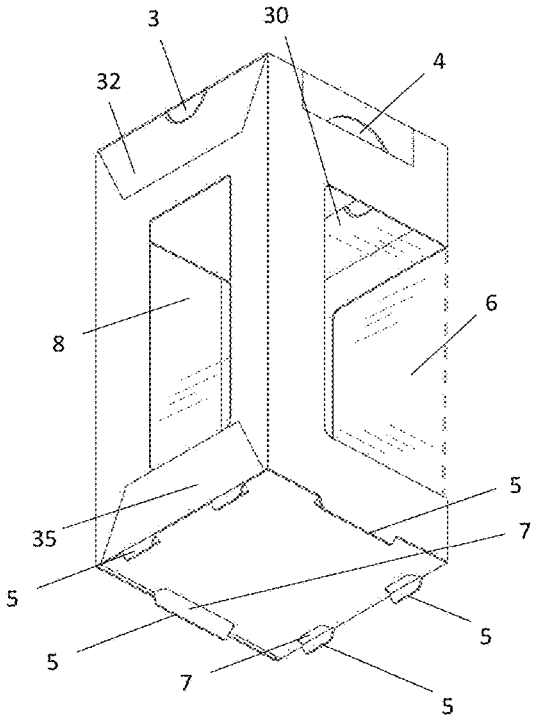
FIG. 1B—packaging box for machine packaging, oblique from below angle

In present embodiment as shown in FIG. 1A it is provided a consumer box for fruit, berries and vegetables or the like, typically in portion pack for consuming direct out of the box.

The packaging box 1 comprises a bottom 40, a top 41, a front wall 42, two side walls 43, 44, and a back wall 45. The packaging box 1 comprise an easy to use pour opening 2. The pour opening is produced such that it is tamper evident in that it is comprised of a perforated 10 easy to tear lines imprinted into the front side of the top side 41 of the packaging box 1, and tear lines 12 extends over the edge and down the upper portion of the front wall of the packaging box. The pour opening 2 flap may have a non-perforated folding edge 11 at its rear side for easy folding up and down when opened, and a grove/opening 4 in front for easy gripping hold when consumer wants to tear open the pour opening 2 for the first time. The grove/opening 4 also provides a ventilation opening. In an alternative embodiment of the pour opening 2 flap, the width 13 of the portion of the pour opening flap 2' extending over the edge and down the upper portion of the front wall 42 of the packaging box increases 12' towards the end of the pour opening flap 2 comprising the grove/opening 4. This may facilitate a better locking ability when the pour opening 2 flap has been teared by the consumer, and the pour opening 2 shall be relocked. An increased width of the front portion 13 of the flap 2, 2' can then be inserted into the opening and the flap portion 2' with increasing width 13 will stick inside the opening and keep the pour opening 2 shut and prevent content to spill out between servings.

Further ventilation may be provided by ventilation recesses 3 on the upper edge of one or more of the packaging box side walls corresponding with holes 3' provided in side flaps 30, 32 of the top 41 of the packaging box 1. When the side flaps 30, 32 are folded in and the top side 41 is locked, the holes 3' corresponds with the ventilation recesses 3 to provide ventilation ducts from the inside of the packaging box 1 to the outside.

Additional ventilation may be provided by openings/holes 9 provided in for example the back wall 45.

The front wall 42, and the side walls 43, 44 may comprise one or more openings 6, 8 for increased visibility of the content inside the packaging box 1. The openings is preferably covered by a transparent film, the transparent film being preferably selected from either recyclable material easy to separate from the box, or a material being decompostable. The transparent film may be of an air permeable material. Alternatively the openings may be constructed as a see through mesh having a multiple holes of small enough size to keep the products inside the box, for example smaller holes for small berries.

For special content requiring darkness the film covering the openings may be provided as non-transparent air permeable film.

Figure 4:
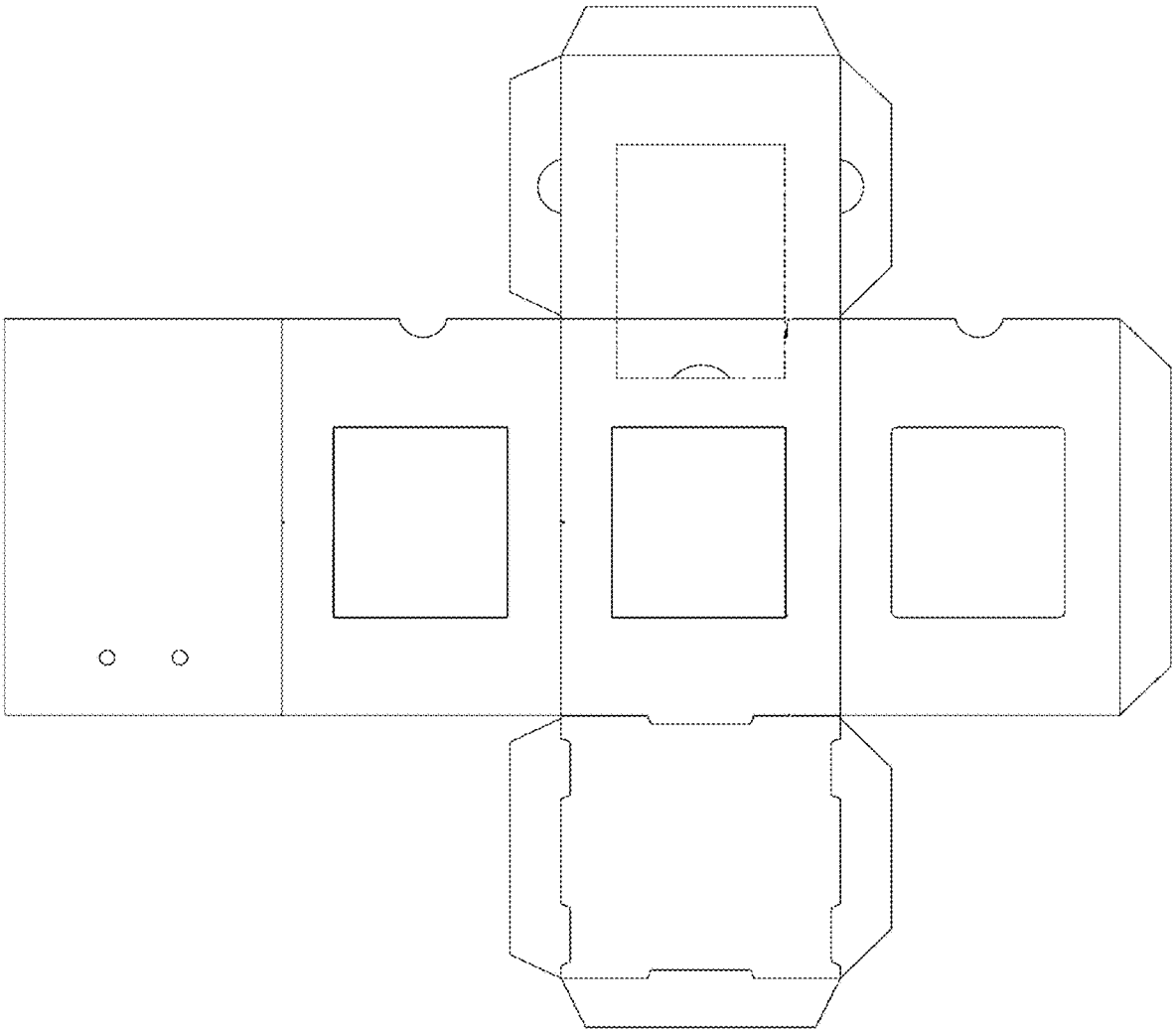
FIG. 4—packaging box for machine packaging, production template, 3 small windows FIG. 5A—packaging box 3 small windows for machine packaging, oblique angle FIG. 5B—packaging box 3 small windows for machine packaging, bottom FIG. 5C—packaging box 3 small windows for machine packaging, front FIG. 5D—packaging box 3 small windows for machine packaging, first side FIG. 6—packaging box for manual packaging, production template FIG. 7A—packaging box for manual packaging, oblique angle first side FIG. 7B—packaging box for manual packaging, oblique angle second side FIG. 7C—packaging box for manual packaging, oblique angle back FIG. 7D—packaging box for manual packaging, first side FIG. 7E—packaging box for manual packaging, second side FIG. 7F—packaging box for manual packaging, top FIG. 7G—packaging box for manual packaging, bottom FIG. 8—stacked packaging boxes FIG. 9A—packaging box with pour opening and side opening, oblique angle FIG. 9B—packaging box with pour opening and side opening, side view FIG. 9C—packaging box with pour opening and side opening, oblique angle and pour opening open FIG. 9D—packaging box with pour opening and side opening, oblique angle and side opening open FIG. 10—packaging box for manual packaging, oblique angle back FIG. 11—packaging box with pour opening and side opening, production template
Figure 5A:
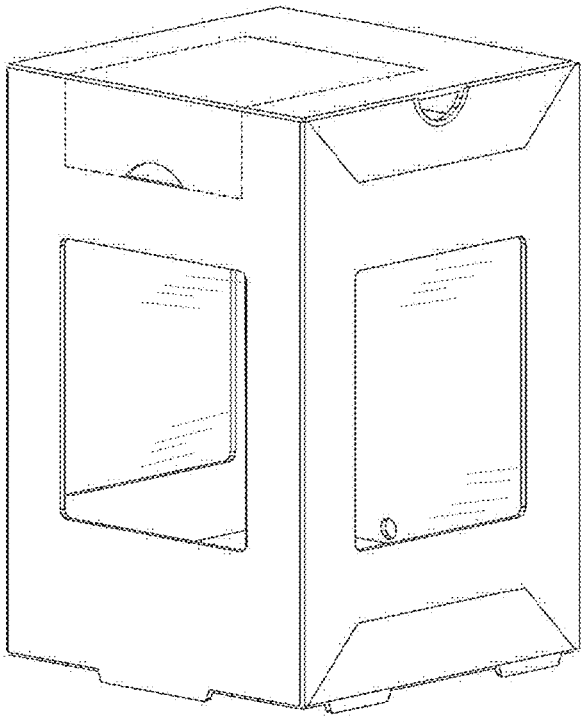
Figure 5B:
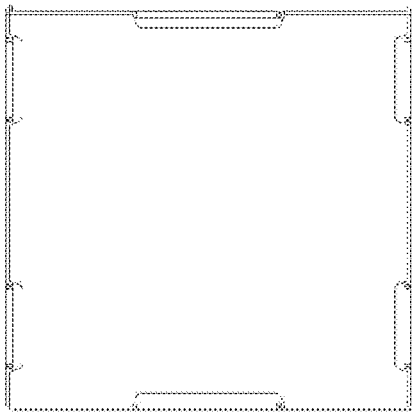
Figure 5C:
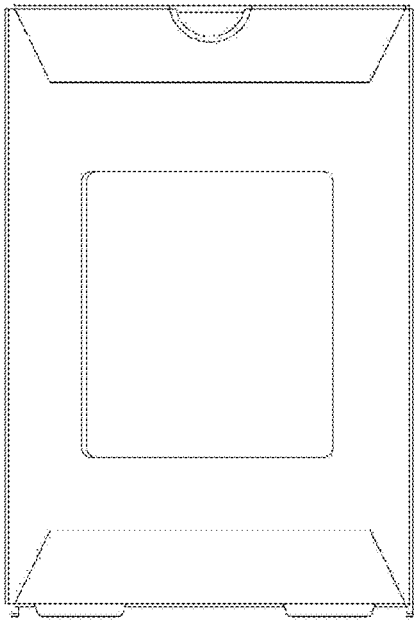
Figure 5D:
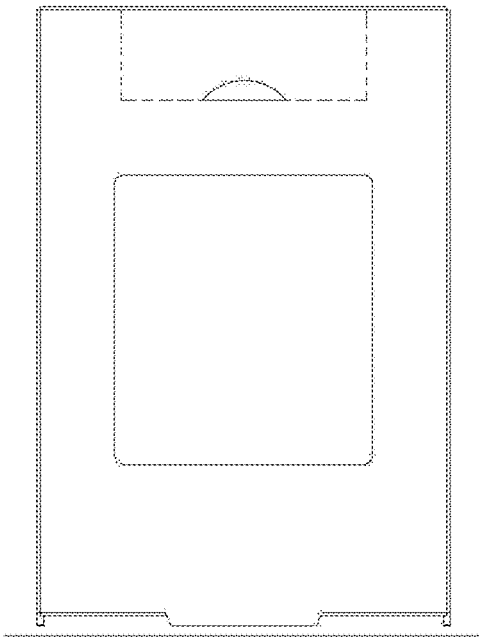

In FIG. 1A it is provided an opening 6 that reach over both the front wall 42 and one of the side walls 44. This creates an increased visibility of the packaged goods enabling a consumer to inspect the packaged goods from more angles simultaneously without needing to twist and turn the packaging box 1. When heavier products are packaged, such as potatoes, a more robust design may be used, and a design having smaller openings as shown in FIGS. 4 and 5A where each transparent opening are smaller and not spanning over a corner between side wall and front wall.

The bottom 40 is constructed with side flaps 33, 34, 35 comprising folding lines, the folding lines being partly perforated 51 through the packaging box material, partly non perforated 50. The folding lines 50, 51 is such that the perforated portions 51 forms a recess 5 into the bottom 40. The effect is that when the bottom 40 is folded in and the flaps 33, 34, 35 are bent inwards to fit inside the corresponding walls 43, 44, 45 of the packaging box 1, the recesses which has a perforated cut through of the material will protrude out from the bottom 40 at an angle and thereby form supporting legs 5 which will when the packaging box 1 is placed on a surface support the packaging box 1. The underside of the bottom 40 will then be resting at a distance above the surface of which the packaging box is placed.

A further advantage of the supporting legs 5 is that when mounted, the folding creates openings 7 in the bottom 40, which provides for ventilation through the bottom between the inside of the packaging box 1 and the outside.

The ventilation via the openings 7 in the bottom 40 and the supporting legs 5 contributes with an important features when multiple packaging boxes 1 are stacked upon each other, for display and/or transport. Ventilation is crucial for keeping fruit, berries and vegetables in a good condition. Ensuring space between the packaging boxes 1 from top of one packaging box 1 to the bottom of the packaging box 1 above ensures that air can circulate 240 from the surrounding through to the bottom openings 7, and hence keep the fruit, berries and vegetables fresh for a longer time period.

The packaging box 1 may be coated/impregnated on the inside to avoid moisture from the fruit, berries and vegetables to degrade the packaging box material.

Figure 2:
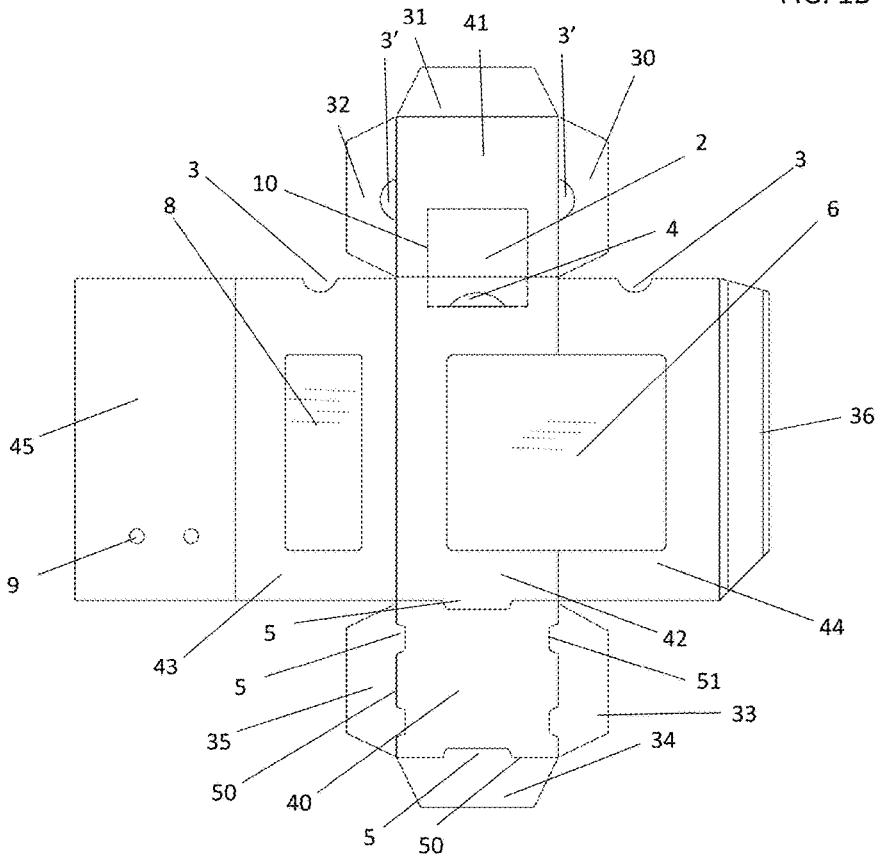
FIG. 2—packaging box for machine packaging, production template
Figure 3A:
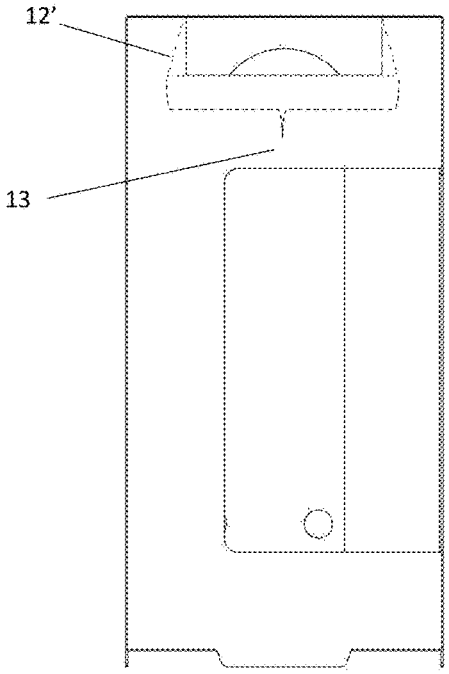
FIG. 3A—packaging box for machine packaging, front
Figure 3B:
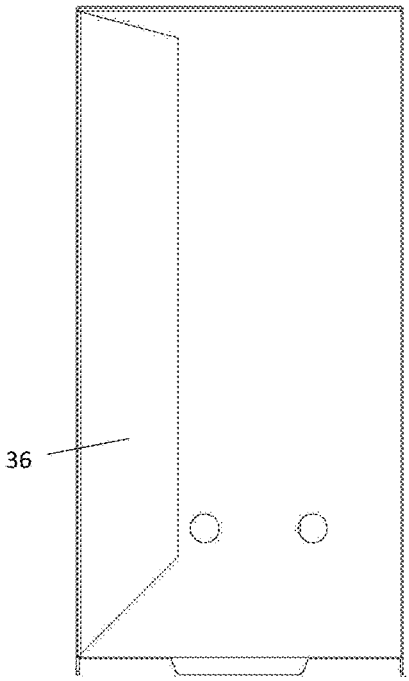
FIG. 3B—packaging box for machine packaging, back
Figure 3C:
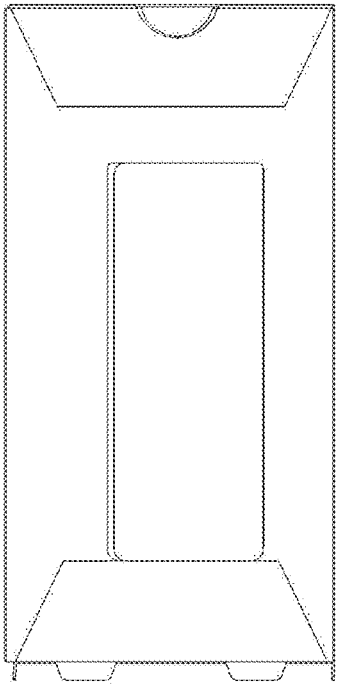
FIG. 3C—packaging box for machine packaging, first side
Figure 3D:
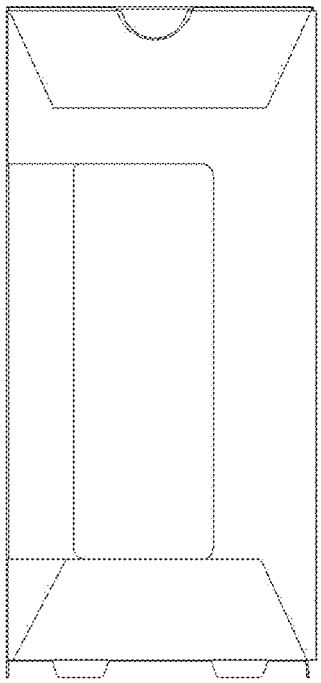
FIG. 3D—packaging box for machine packaging, second side
Figure 3E:
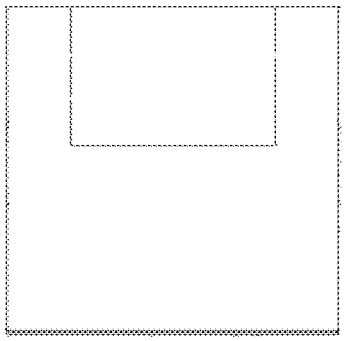
FIG. 3E—packaging box for machine packaging, top
Figure 3F:
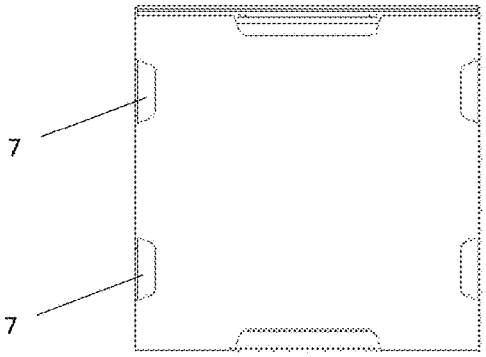
FIG. 3F—packaging box for machine packaging, bottom

When the packaging box 1 is produced in a cardboard material it will start as a die cut form as shown in FIG. 2 when produced for machine assembly and filling. Typically the side flaps 33, 34, 35 are covered with a glue on the outside such that when folded in the machine assembly the glue is activated with the effect that the side flaps 33, 34, 35 will glue to the inside of the side walls 43, 44 and the back wall 45 respectively. Further one of the side walls 44 will have a wall side flap 36 connected on its peripheral side relative its connection to the front wall 42. The wall side flap 36 may be coated with a glue which when the cardboard box is machine assembled be glued to the inside of the back wall 45, as illustrated in FIG. 3B.

The flaps are shown in the figures of the assembled packaging boxes 1 to increase the understanding of how the flaps contribute to the assembling. When mounted the flaps are normally on the inside of the packaging box 1. Outside mounting of the flaps may be facilitated in some applications, in which the glue must be arranged on the opposite side of the flaps.

AS with the bottom 40, the top 41 flaps 30, 31, 32 may be glued to the side walls 43, 44 and the back wall 45 similar to the bottom 40.

An assembly and filling process may fill from bottom or the top, having the effect that the wall side flap 36 must firstly be arranged/glued to the back wall 45, hence a tube is formed by front wall 42, sidewalls 43, 44 and back wall 45, and either of top or bottom must be mounted to form an open container with the tuber form. Then the container is filled with its intended content, and the other of top or bottom is mounted.

The present invention of the packaging box is presented as discussed above in two versions for machine mounting and filling having a die cut form as provided in FIGS. 2 and 4.

Figure 6:
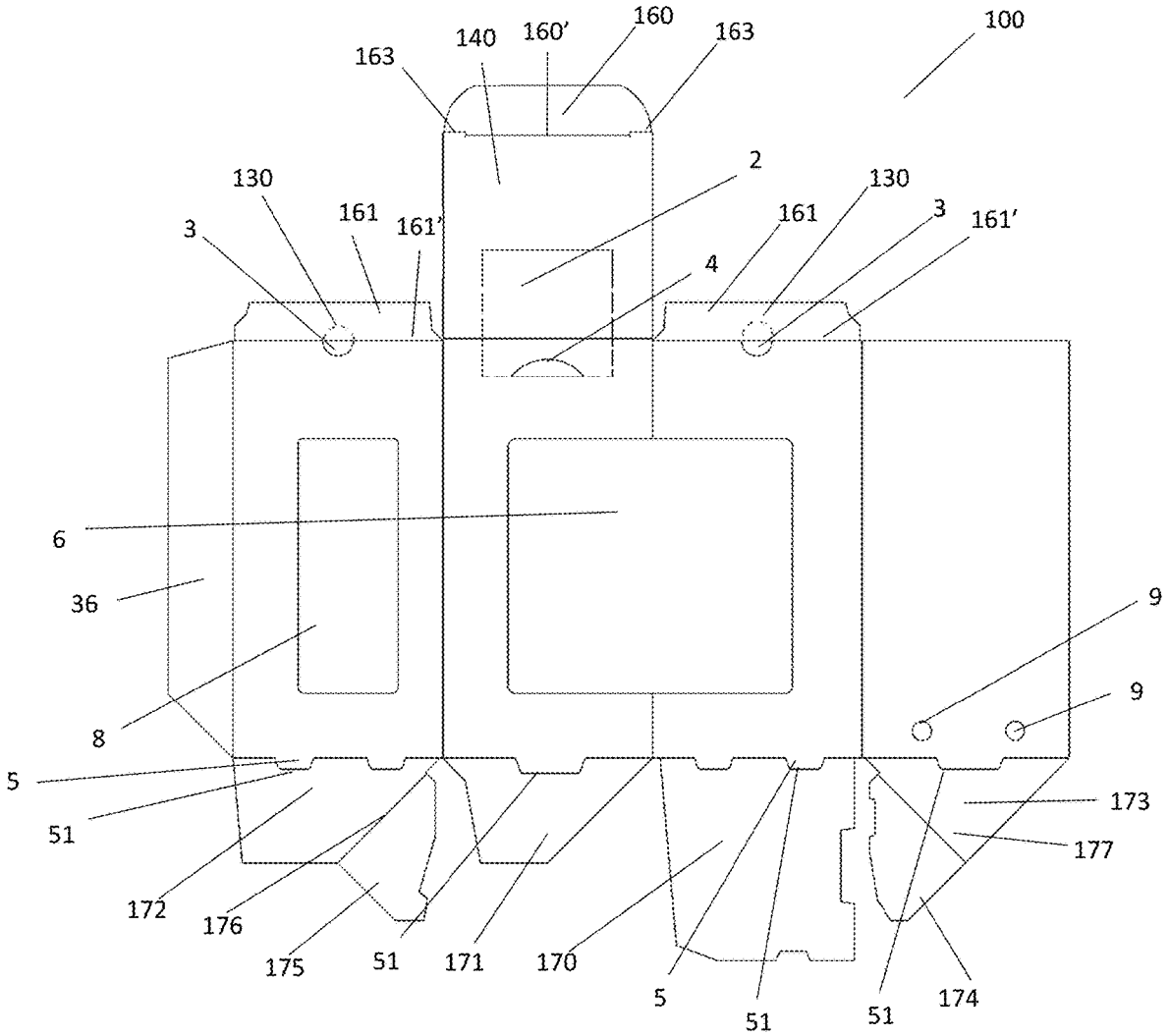
Figure 7A:
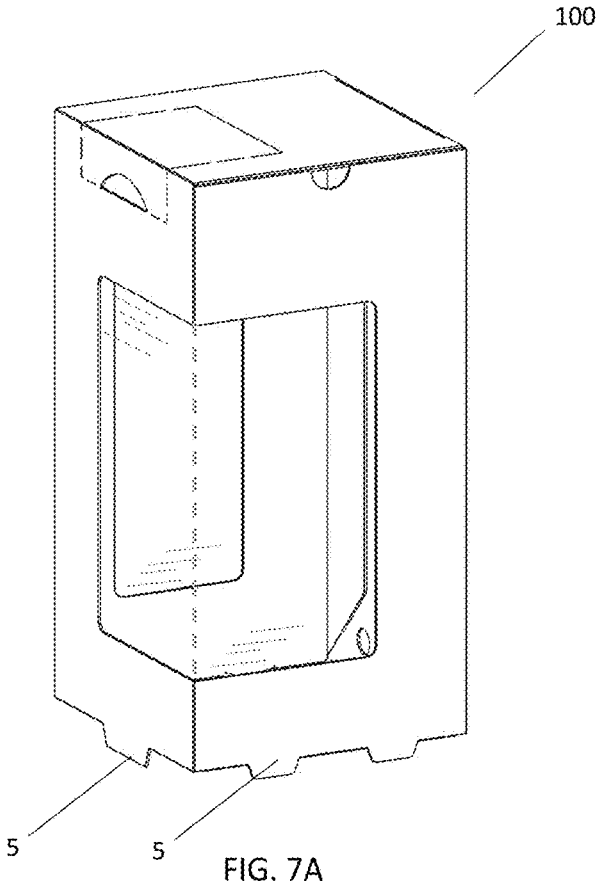
Figure 7B:
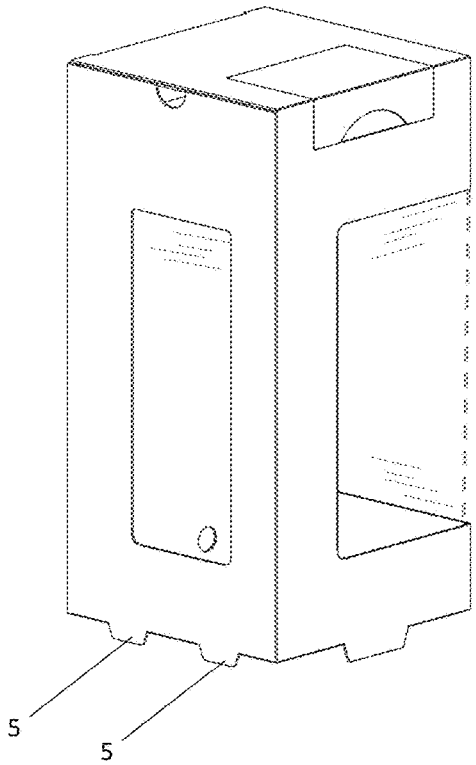
Figure 7C:
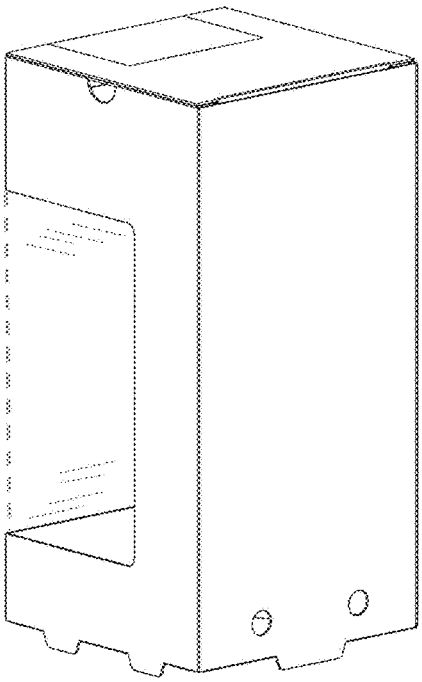
Figure 7D:
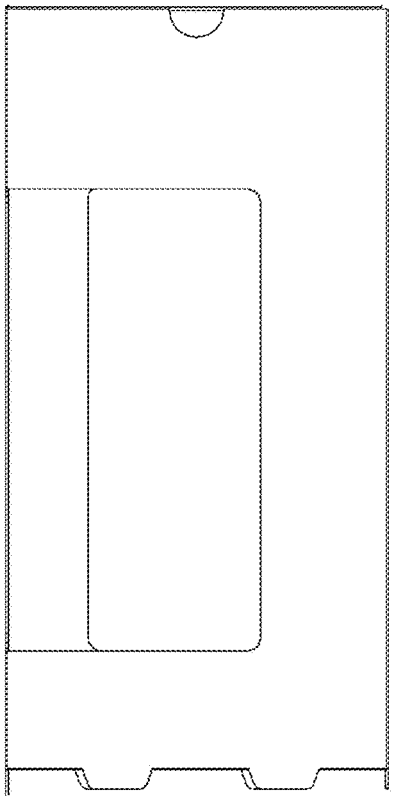
Figure 7E:
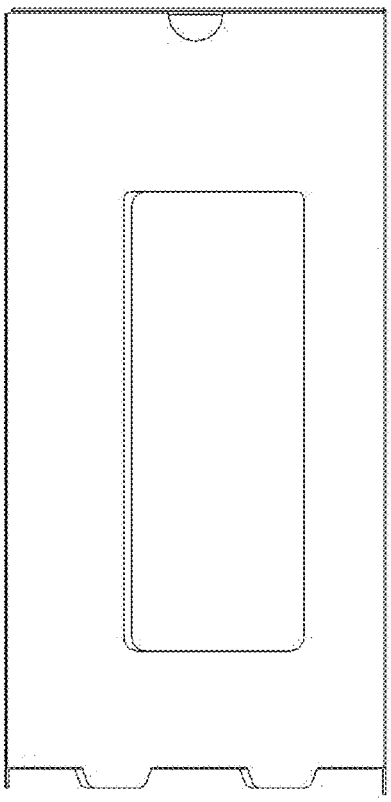
Figure 7F:
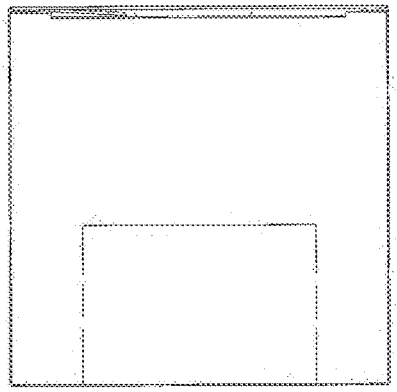
Figure 7G:
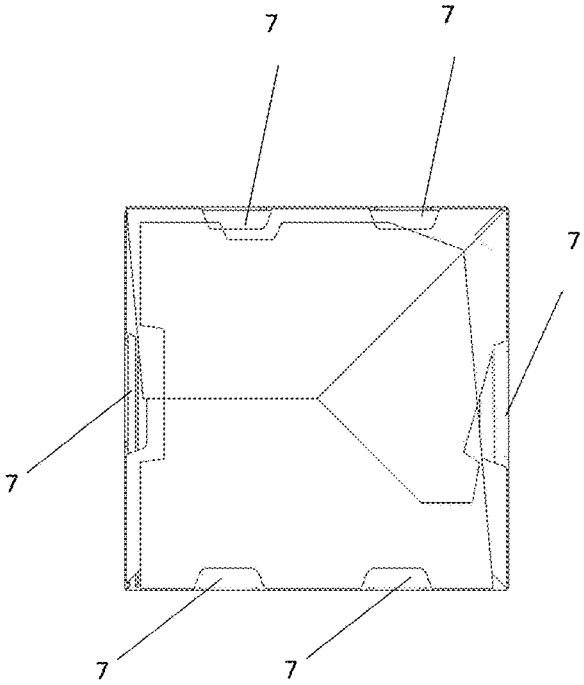
Figure 8:
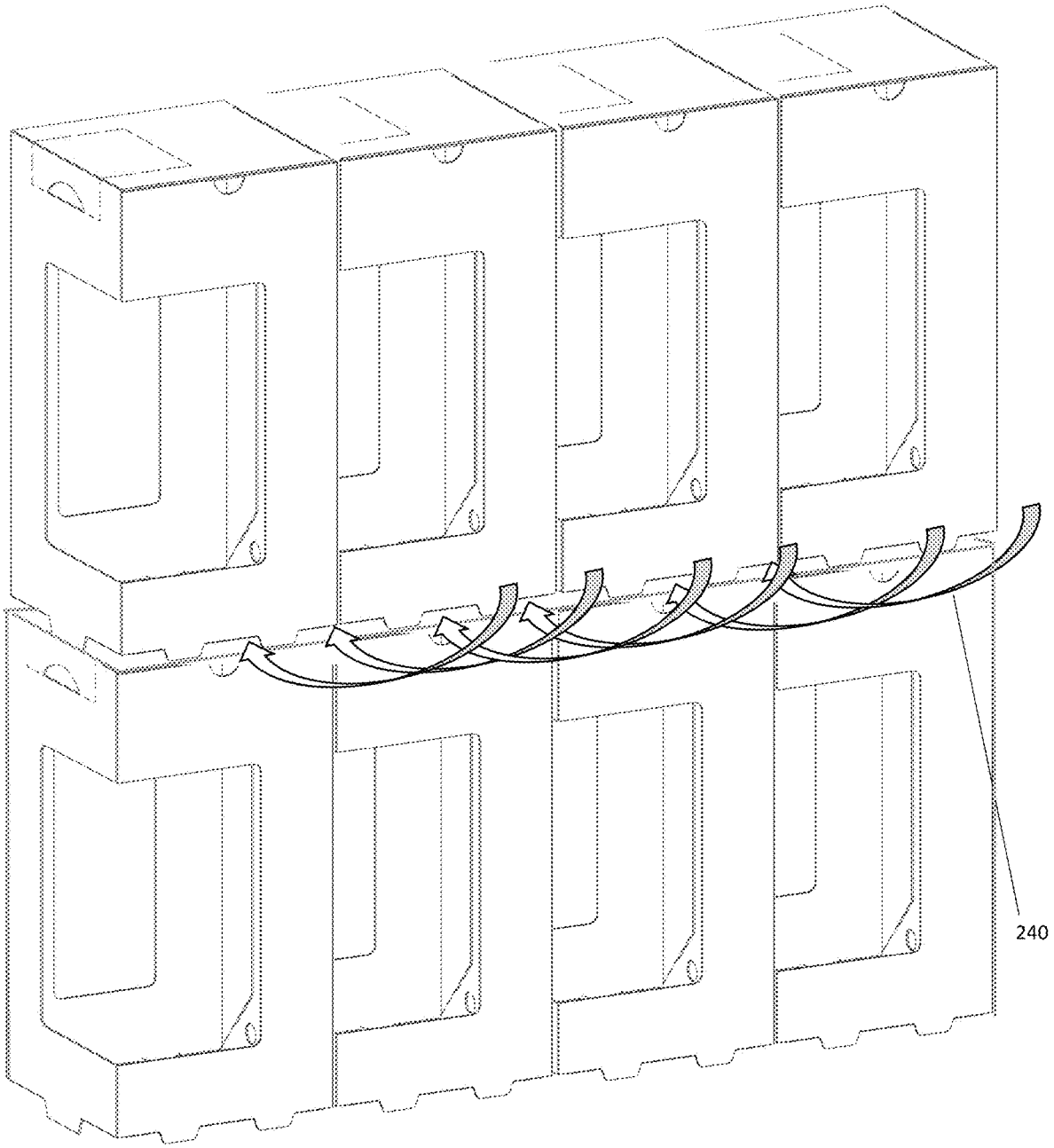

A further embodiment of the present invention of a packaging box 100 is provided in a version intended for manual filling and packaging as illustrated in one embodiment in FIG. 6 to FIG. 7G. The features of the pour feature comprising: pour opening flap 2, 2', ventilation in top 4, ventilation in walls 3, 9 and ventilation in holes 7 via the supporting legs 5, the supporting legs the transparent openings 6, 8 and a wall side flap 36 corresponds to the machine mountable packaging box 1 as described above.

Differences are found in the top and bottom. In a manual assembly line it is difficult to facilitate heating respondent glue and pressure application to various part in an efficient manner. It is therefore invented a semi-automated process where the packaging box 100 may be machine glued into a tube, that is after cutting: the side walls 43, 44, front wall 42 and back wall 45 is connected by gluing wall side flap 36 of the outermost side wall to the back wall, to form a four sided tube which can easily be flattened by folding to sides over to other two sides for space saving transport.

The bottom parts and flaps are constructed as foldable parts that may easily be spot glued on site by manual labor.

In the embodiment shown in FIG. 6-7G, the bottom 170 is folded first providing an even floor for the content intended to be packed covering most of the bottom area. This provides an even surface without the risk of goods falling down into any cracks or opening in the bottom. When bottom is folded, the underside of the smaller lower flap 171 is folded over the bottom 170. Then the lower side wall flap 172, 175 may be provided with a small amount of glue on the inward facing side of its outer portion 175 in a manner that when pressed towards the bottom from the underside, lower side wall flap 172, 175 is glued to the smaller flap 171 in the region of the outer part of lower side flap 175, and further lower back wall flap 173, 174 may be provided with a small amount of glue on the inward facing side of its outer portion 174 in a manner that when pressed towards the bottom 170 from the underside, lower back wall flap 173, 174 is glued to inner part of the bottom 170 in the region of the outer part of lower back wall flap 174.

The lower back wall flap 173, 174, and lower side wall flap 172, 175 may be manufactured with a folding line 176, 177 that biases the folded flaps 173, 174, 172, 175 in a concave manner and provide a foldable bottom that can be glued in the manufacturing process. In this manner the tube discussed above can be a container with sides and a bottom being flattened by pushing the two pair of bottom parts inwards into the tube part, and when the container shall be filled with content, it simply is folded out and the bottom of the container will flip down in place in a locking manner once the bottom 170 stands perpendicular to the walls.

This folding and gluing, fixing various flaps to each other and keeping some parts non glued creates a flexible double bottom of the packaging box 100, where if desired the bottom can be moved inwards in a resilient manner, but securely keeping any content inside. The inside floor represented by the inside of the bottom 170 can be lifted by a light pressure (by a finger pushing) on the outside bottom of the packaging box. If some of the content has stuck in a bottom corner itis possible to loosen it by simply turning the packaging box 100 and give it a slight push on the bottom. The bottom floor inside the packaging box 100 raises a little and the cracks in the bottom corner becomes bigger and the goods will loosen.

The lower back wall flap 173, 174, and lower side wall flap 172, 175 may be manufactured with a folding line 176, 177 that biases the folded flaps 173, 174, 172, 175 in a concave manner once they are pushed in one time after gluing. This biased position will create a lift of the inside bottom 170, which again improves the ventilation effect of the ventilation holes provided by the supporting holes 7 associated with the legs 5.

The packaging box 100 for manual filling may be provided with side wall upper flaps 161, extending out from the upper side of the side wall having a folding line 161' imprinted in the material. Likewise the top 140 have a flap 160 arranged in the distal end and a folding line 160' for folding. The folding line may be shortened by cut through portions 163. When the content is filled into the packaging box 100, the upper side wall flaps 161 is folded inwards, and the top 140 flap may be folded over and closing the packaging box 100 by inserting the top flap 160 between the edge of the side wall upper flaps 161 closest to the back wall and the back wall itself. The cut through portions 163 will create a snap lock effect towards the sides of the side wall upper flaps 161, and the lock will stay fixedly closed. Even if this manual packaging version is not completely tamper evident, it requires a lot more to open and remove content. Such an attempt will easily be observed in for example a shop.

In the above discussed embodiments, the front wall 42, the side walls 43, 44 and the back wall 45 is described with associated flaps openings and ventilation features. The order of combinations of features and its placing arrangements can be interchanged. Transparent openings can be anything from 1 to many, of which one or more may span over two adjacent sides.

Figure 9A:
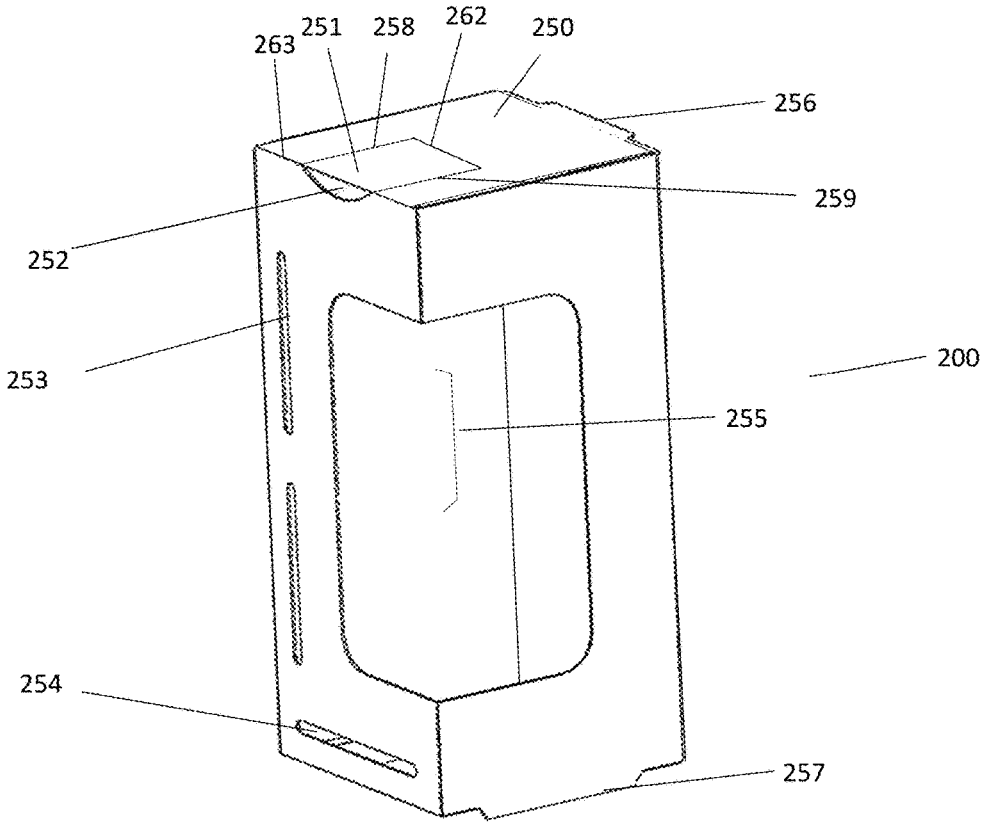

Further advantageous embodiments of the novel packaging box 200 is illustrated in FIG. 9A to 30, where FIG. 9A shows the packaging box with a top pour opening at an oblique angle.

In this embodiment the pour opening flap 251 is residing entirely on the top side, being defined by:

- two tear-lines 258, 259, for example parallel, running at an angle, for example perpendicular, from the front edge 263 of the top side 250, and an embossed bending line 262 between the inner ends of the two parallel tear-lines 258, 259.

The lengths of the two tear-lines 258, 259, which defines a pour opening depth is at least longer than the circumference of the content to be poured out from the packaging box. Typically, if the content is blueberries, a length of 2-4 cm. The width between the two tear-lines 258, 259, which defines a pour opening width is at least longer than the circumference of the content to be poured out from the packaging box. Typically, if the content is blueberries, a width of 2-4 cm. Other dimensions may be adapted to the size of content members to be packed in the packaging box and for providing a preferred pour speed out a the pour opening 270 provided when the pour opening flap 251 has been pulled open as illustrated in FIG. 9C.

A grove/opening 252 is provided for increased ventilation inside the packaging box, and when arranged at the top edge 273 of the front side 274 and aligned with the front edge of the pour opening flap 251, such that when packaging box is filled with content and a consumer wants to tear open the pour opening flap 251 for the first time, it provides for easy gripping of the pour opening flap 251 for tearing and opening the flap 251 along the tear-lines 258, 259. When the pour opening flap 251 has been opened to provide a pour opening 270, it can easily be locked by pushing the pour opening flap 251 back inside the pour opening 270 to close the pour opening. Perforation tags 271, 272 from the perforated tear edges may further aid in holding the pour opening flap 251 in a closing position. The pour opening flap may be designed to have a different than rectangular design to increase the closing ability after the pour opening flap 251 has been opened the first time.

Figure 9B:
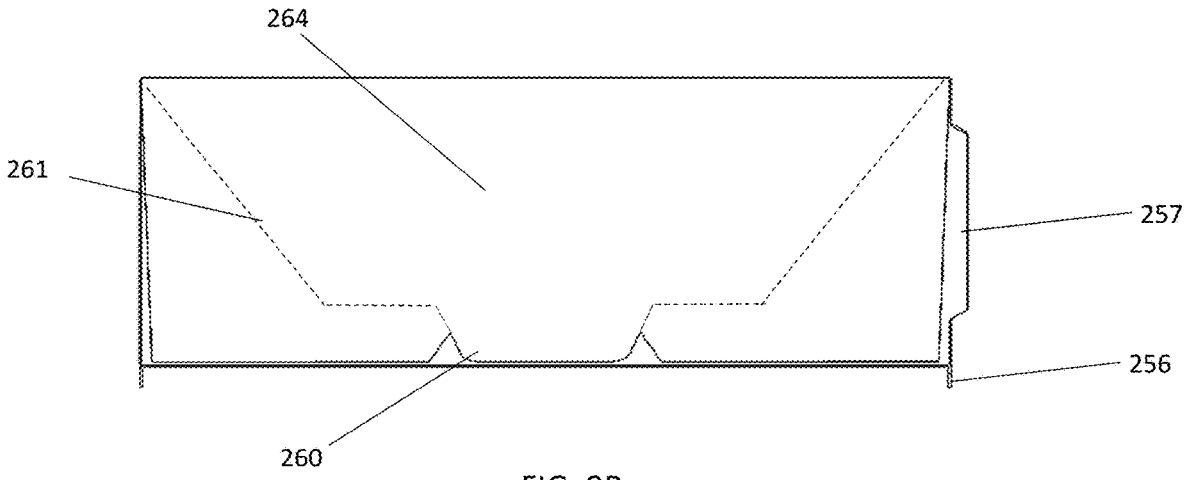
Figure 9C:
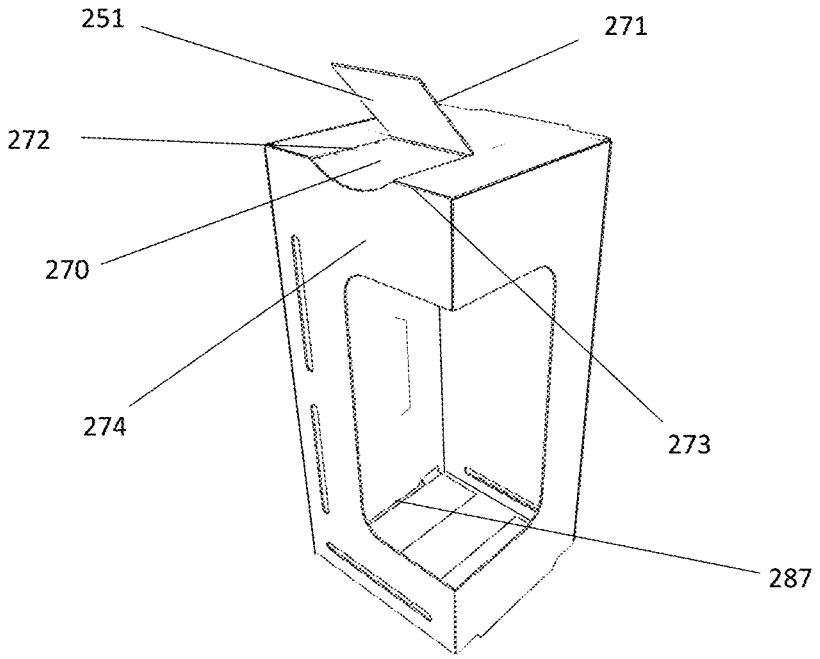
Figure 9D:
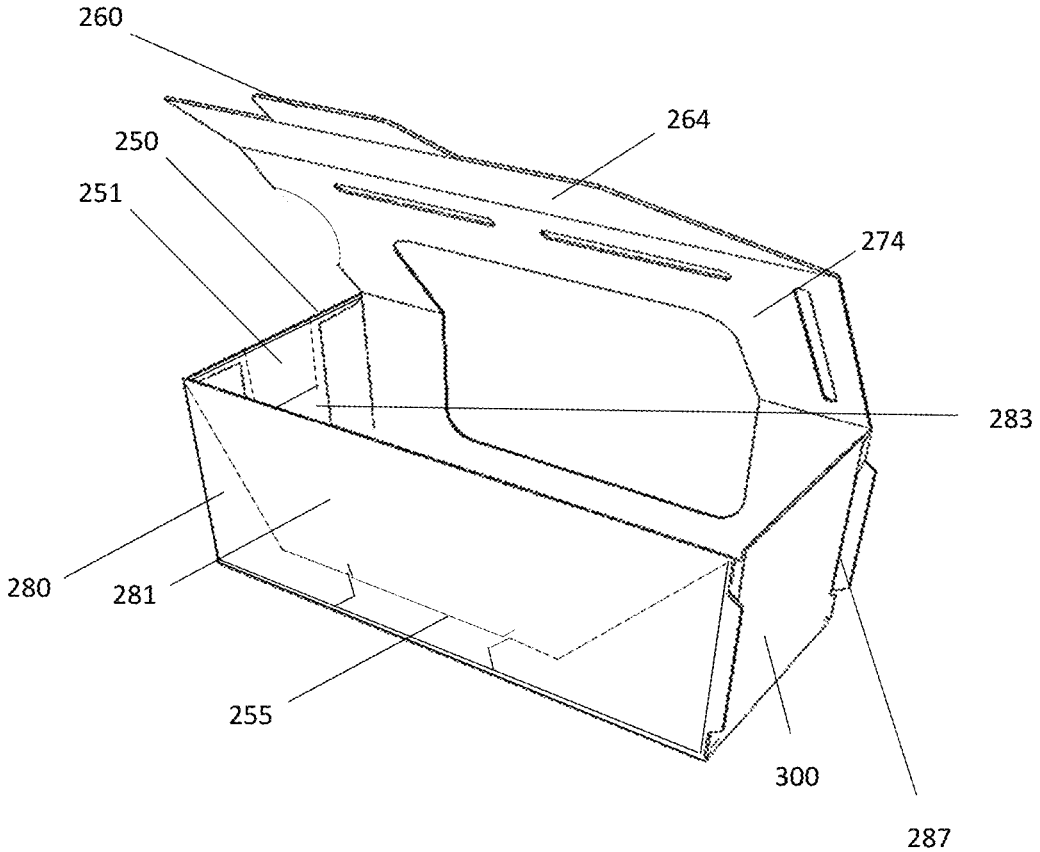
Figure 10:
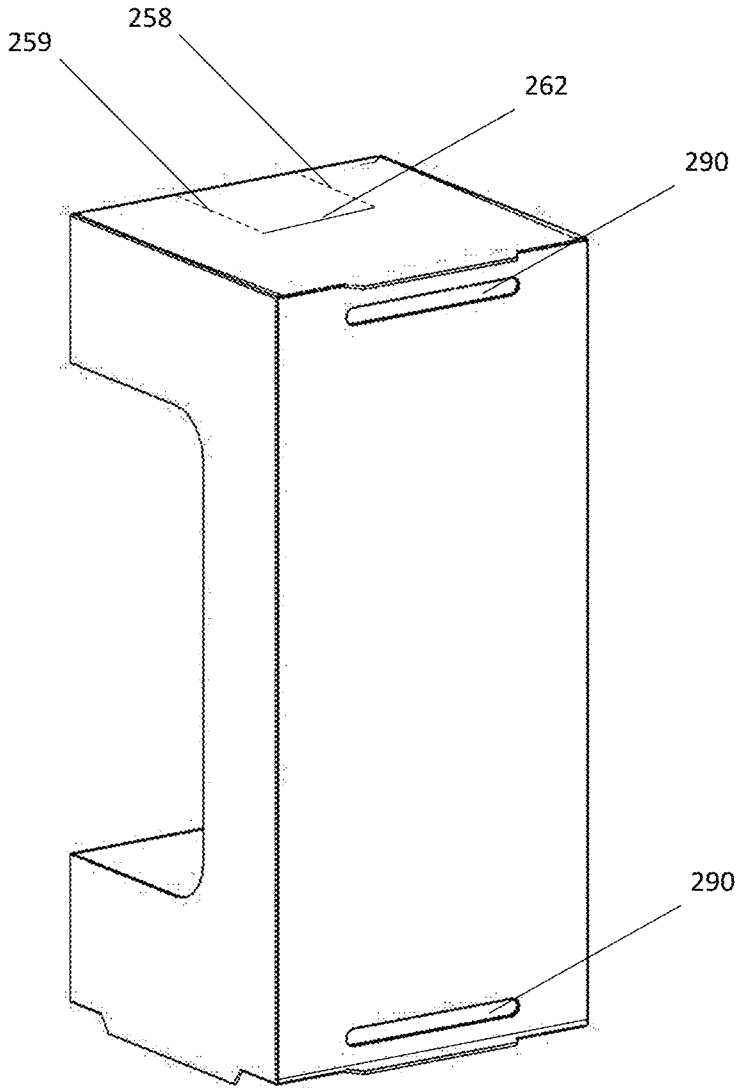
Figure 11:
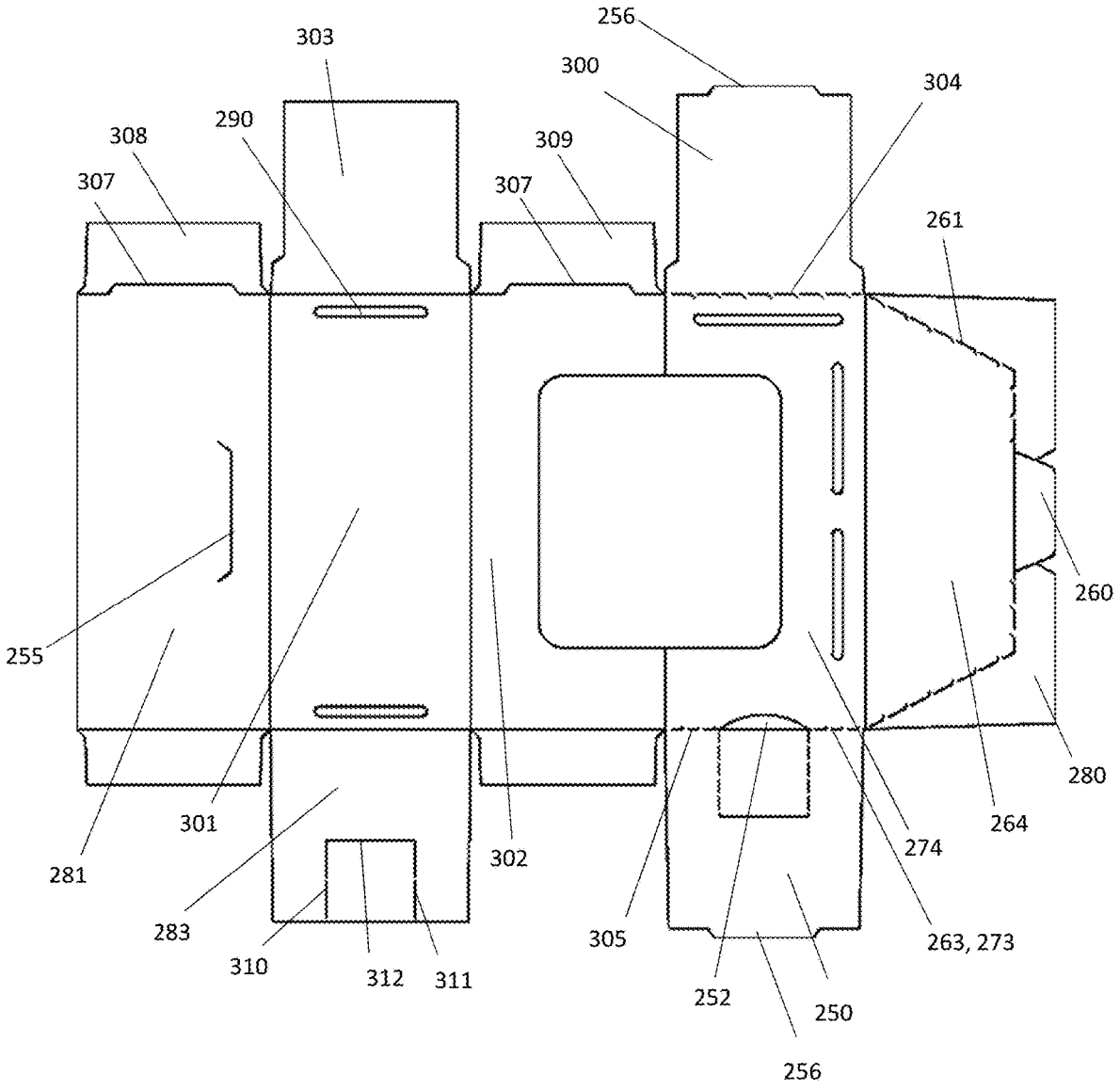

In a further advantageous embodiment the packaging box comprise a tearable opening feature in a side wall 264 opening as illustrated in FIGS. 9B and 9D. The packaging box may be provided with a double side wall comprising an inner side wall 281 and the tearable side wall 264. The tearable side wall 264 is attached on one side to the front side 274 of the packaging box as shown in FIG. 11 of a production template of the packaging box. An outer top side 250 and outer bottom side 300 is in one of their sides attached to respective upper and lower side of the front wall 274 via tear lines 305, 304. The double layer side wall 264, 281, and similarly double bottom 303, 300, and double top 250, 283, is provided to define a box with a bottom 301 and 4 walls 281, 283, 302, 303, such that before front side 274, outer bottom side 300, outer top side 250 and side wall 264 is glued/fixed the box may be filled with content. The assembled packaging box may after filling be closed with the side wall 264, and top 250 and bottom 300. The side wall being tearable along a tear line 261, once the front side 274, outer bottom side 300, outer top side 250 and side wall 264 is locked and glued/fixed.

Thus when opening a box with content for the first time a customer may start gripping a gripping tongue 260 being provided protruding from the tearable portion of the side wall 264, and tear the side wall 264 along the side wall tear line 261, and continue to tear the front side 274 along the front side tear lines 304, 305, and thus being able to open the box as illustrated in FIG. 9D. Instead of, or partly substituting, a portion of the gripping tongue 260, a ventilation hole arranged adjacent the gripping portion of the tearable portion of the side wall 264 may be provided (not shown) for easy gripping of the tearable portion and for additional ventilation.

Independently of the side wall 264 being provided with a tearable opening, the packaging box may be designed for side filling, but comprising only top side pour opening flap 251 for opening and pouring the content out of the packaging box. When top side 250, 283 has an outer top side 250 and an inner top side 283, the inner top side 283 may advantageously have corresponding and aligned tear lines 310, 311 with the outer top side tear lines 258, 259, and corresponding and aligned embossed bending line 312 with the outer top side embossed bending line 262.

The outer tearable side wall 264 may be fastened/glued to the inner side wall 281, the fastening means/glue then being arranged/effective only between a portion 280 of the tearable side wall 264 not intended to be lifted when sidewall is teared. The inner side wall 281 may further comprise a slot 255 adapted for receiving the gripping tongue 260 after the packaging box has been opened with the side opening and thus provide a closing feature enabling the box to be closed and opened repeatedly. When side wall 264 is teared open along the side wall tear line 261, a portion of the side wall 264 can be lifted together with the front side wall 274 as illustrated in FIG. 9D. The side wall portion 280 will be left fastened/glued together with the inner side wall 281.

The outer top side 250 and outer bottom side 300 may further comprise a protruding portion 256 arranged at their outer side opposite the side connected to the front side 274. The protruding portions 256 constitutes supporting legs 256 sticking out from the back side 301 when packaging box is mounted. The supporting legs 256 will ensure that the packaging box backside 301 will be elevated from a surface on which it rests when laying with the back side 301 down, and ventilation holes 290 may be arranged in the back side 301 to enhance flow of air from outside into and through the internal of the box.

Further, bottom side supporting legs 257 and bottom ventilation holes 287, may both be created by providing cut through lines 307 in a portion of the bending line between the folding lips and the bottom of the sides 281, 302 such that when folding lips 308, 309 is folded under the inner bottom side 303, the supporting legs 257 will stand out in a protruding manner, and the ventilation holes 287 is formed in the space where the supporting legs 257 where originally before folding, the supporting legs 257 further providing a ventilation passage from the surroundings through the ventilation holes 287 when packaging box is standing on a surface.

Alternatively the backside 301 and attached inner bottom side 303 and inner top side 283 side may have similar cut through lines in a portion of the bending line between both inner bottom 303 and inner top 283 sides and the back side 301, the protrusion being defined inward on the back side 283, as discussed above (not shown) to substitute the supporting legs 256 protruding from the side wall 301 when mounted. Such that when inner bottom 303 and inner top 283 sides is folded, the supporting legs will stand out in a protruding manner, and the ventilation holes is formed in the space in the back side 301 where the supporting legs where originally before folding, the supporting legs further providing a ventilation passage from the surroundings through the ventilation holes when packaging box is lying on its backside 301 on a surface. This alternative supporting leg design makes the precut back side ventilation holes 290 superfluous, and may be omitted without sacrifice of ventilation flow through the packaging box when it rests on the back side 301.

Further ventilation holes 253, 254 may be provided on sides, top and bottom to increase ventilation inside the packaging box.

All tear lines 258, 259, 261, 304, 304 may be partially perforated lines cut through or almost cut through the side or edge of the side/top wall it is arranged. The purpose is to provide a defined tearing line/edge when a tearing force is applied.

The invention may thus be described as a Packaging box 1, 100, 200 for fruit, berries and vegetables comprising 4 side walls 42, 43, 44, 45, 264, 274, 302, 301, a top side (41, 140, 250) and a bottom side 40, 170, 300, a portion of a side or the top comprising an opening portion 2, 251, 264 for providing access to the content of the packaging box 1, 100, 200, the opening portion 2, 251, 264 comprising tear lines 10, 258, 259, 261, 304, 305 for opening the opening portion and means 4, 252, 260 for accessing a tearing grip of the opening portion. The means for accessing the tearing grip of the opening portion is a ventilation opening 4, 252, and where the opening portion 252 may be arranged towards the front edge of the top side 250, and the ventilation opening 252 may be arranged at the top edge of the front side 274 wall aligned with the opening portion 251, for easy gripping of the opening portion 251.

The invention can further be described as the following:

A first device embodiment of a packaging box for fruit, berries and vegetables comprising:

four walls 42, 43, 44, 45 comprising a front wall 42 two side walls 43, 44 and a back wall 45, a top side 41, 140 and a bottom 40, 170, and a pour opening 2 for tamper evident opening and pouring of content stored inside the packaging box 1, 100, the pour opening 2 being arranged to span over a portion of the top side 41, 140 and over the edge of the fixedly connected front wall 42 and a portion of the pour opening flap 2' extending over the edge and down the upper portion of the front wall 42 of the packaging box 1, 100.

A second device embodiment of a packaging box according to the first device embodiment further comprising:

supporting legs 5 and bottom ventilation holes 7, both being created by cut through lines 51 in the die cut form corresponding to the bottom 40, 170, 171, 172, 173, such that when the bottom is folded the supporting legs 5 will stand out in a protruding manner, and the ventilation holes 7 are formed in the space where the supporting legs were originally before folding, the supporting legs further providing a ventilation passage 240 from the ventilation holes 7 to the surroundings when packaging box 1, 100 is standing on a surface.

A third device embodiment of a packaging box according to the first or second device embodiment further comprising:

the pour opening 2 being defined by a tamper evident perforated 10 easy to tear lines imprinted into the front side of the top side 41, 140 of the packaging box 1, 100, and tear lines 12 extends over the edge and down the upper portion of the front wall 42 of the packaging box 1, 100, and further comprising a non-perforated folding edge 11 at its rear side for easy folding up and down when opened.

A fourth device embodiment of a packaging box according to any of the first to third device embodiment further comprising:

the pour opening 2 being provided with a grove/opening 4 in front for easy gripping hold when consumer wants to tear open the pour opening 2 for the first time, the grove/opening also constitutes a ventilation opening.

A fifth device embodiment of a packaging box according to any of the first to fourth device embodiment further comprising:

the pour opening 2 being defined by a tamper evident perforated 10 easy to tear lines imprinted into the front side of the top side 41, 140 of the packaging box 1, 100, and tear lines 12' extends over the edge and down the upper portion of the front wall 42 of the packaging box 1, 100, wherein the flap portion defined by tear lines 12' comprised in the upper portion of the front wall 42 increase in width 13 towards the end, thereby providing a secure open/lock function even after pour opening 2 has been teared open the first time.

A sixth device embodiment of a packaging box according to any of the first to fifth device embodiment further comprising:

one or more openings 6, 8 in any of the four walls 42, 43, 44, 45, wherein a film is arranged to provide an enclosure within the packaging box 1, 100.

A seventh device embodiment of a packaging box according to the sixth device embodiment, wherein the film is made of an air permeable transparent film.

An eighth device embodiment of a packaging box according to the sixth device embodiment, wherein the film is made of an air permeable non-transparent film.

A ninth device embodiment of a packaging box according to any of the sixth to eighth device embodiment, wherein any opening spans over an edge between adjacent walls 42, 43, 44, 45.

A tenth device embodiment of a packaging box according to any of the first to ninth device embodiment further comprising:

ventilation openings 3, 3', 9 in any of upper portion of walls 42, 43, 44, 45, flaps 30, 32 or lower part of back wall 45.

An eleventh device embodiment of a packaging box according to any of the first to tenth device embodiment, wherein the bottom 170, 171, 172, 173 is a double bottom for manual filling, comprising a first bottom 170 providing an even floor for the content intended to be packed covering most of the bottom area, a smaller lower flap 171, the lower side wall flap 172, 175 glued to the smaller flap 171 in the region of the outer part of lower side flap 175, and further lower back wall flap 173, 174 glued to the bottom 170, in the region of the outer part of lower back wall flap 174, thereby providing a flexible bottom of the packaging box 100 provide a foldable bottom that can be glued in the manufacturing process.

A twelfth device embodiment of a packaging box according to any of the first to eleventh device embodiment, wherein the material used in the packaging box 1, 100 is cardboard.

What is claimed is:

1. A packaging box for fruit, berries and vegetables comprising:

four side walls, a top side and a bottom side, a portion of a side or the top side comprising an opening portion for providing access to contents of the packaging box, the opening portion comprising tear lines for opening the opening portion and means for accessing a tearing grip of the opening portion, means for accessing the tearing grip of the opening portion including a ventilation opening, and supporting legs and bottom ventilation holes, wherein the supporting legs and the bottom ventilation holes are created by cut through lines in a die cut form corresponding to the bottom side, such that when the bottom side is folded the supporting legs stand out in a protruding manner, wherein the bottom ventilation holes are formed in a space where the supporting legs were originally before folding, the supporting legs further providing a ventilation passage from the bottom ventilation holes to surroundings when the packaging box is standing on a surface, the bottom side of the packaging box being lifted a distance above the surface by the supporting legs.

2. The packaging box according to claim 1, wherein the opening portion is arranged towards a front edge of the top side, and the ventilation opening is arranged at the top edge of the front side wall aligned with the opening portion, for easy gripping of the opening portion.

3. The packaging box according to claim 1, wherein the opening portion is arranged to span over a portion of the top side and over an edge of the front side wall of the four side walls and a portion of a pour opening flap extending over the edge and down an upper portion of the front side wall of the packaging box, and the pour opening portion being provided with a grove/opening in front for easy gripping hold when a consumer wants to tear open the opening portion for a first time, the grove/opening also constitutes the ventilation opening.

4. The packaging box according to claim 1, further comprising:

the opening portion being defined by tamper evident easy to tear lines imprinted into sides comprising the opening portion, and further comprising a folding edge at a rear side of the opening portion for easy folding up and down when opened.

5. The packaging box according to claim 3, further comprising:

the opening portion being defined by tamper evident perforated easy to tear lines imprinted into the front side of the top side of the packaging box, and tear lines extends over the edge and down the upper portion of the front side wall of the packaging box, wherein a flap portion defined by tear lines comprised in the upper portion of the front side wall increase in width towards an end, thereby providing a secure open/lock function even after pour opening has been teared open the first time.

6. The packaging box according to claim 1, further comprising:

one or more openings in one or more of the four side walls, wherein a film is arranged to provide an enclosure within the packaging box.

7. The packaging box according to claim 6, wherein the film is made of an air permeable transparent film or an air permeable non-transparent film.

8. The packaging box according to claim 6, wherein any opening of the one or more openings spans over a corner between adjacent walls.

9. The packaging box according to claim 1, further comprising:

ventilation openings in one or more of an upper portion of the four side walls, flaps or a lower part of a back side wall of the four side walls.

10. The packaging box according to claim 1, wherein the packaging box comprises a cardboard material.

* * * * *